United States Patent [19]

Linecker

[11] 4,392,313

[45] Jul. 12, 1983

[54] SHOE FOR USE WITH A CROSS-COUNTRY SKI

[76] Inventor: Josef Linecker, Rosengasse 5, A 5230 Mattighofen, Austria

[21] Appl. No.: 122,698

[22] Filed: Feb. 19, 1980

Related U.S. Application Data

[62] Division of Ser. No. 892,770, Apr. 3, 1978, Pat. No. 4,235,452.

[30] Foreign Application Priority Data

Apr. 13, 1977 [AT] Austria ..... 2578/77
Feb. 9, 1978 [AT] Austria ..... 924/78

[51] Int. Cl.[3] ..... A43B 5/04; A43B 13/12

[52] U.S. Cl. ..... 36/117; 36/30 R

[58] Field of Search ..... 36/117, 32 R, 25 R, 36/30 R

[56] References Cited

FOREIGN PATENT DOCUMENTS 2326754 12/1974 Fed. Rep. of Germany ..... 36/117

*Primary Examiner*—Patrick D. Lawson
*Attorney, Agent, or Firm*—Kurt Kelman

[57] ABSTRACT

A cross-country ski boot comprises a sole of synthetic resin and including a heel portion defining a recess of V-shaped cross section and upwardly projecting lateral edges forwardly of the heel portion.

20 Claims, 12 Drawing Figures

FIG. 11
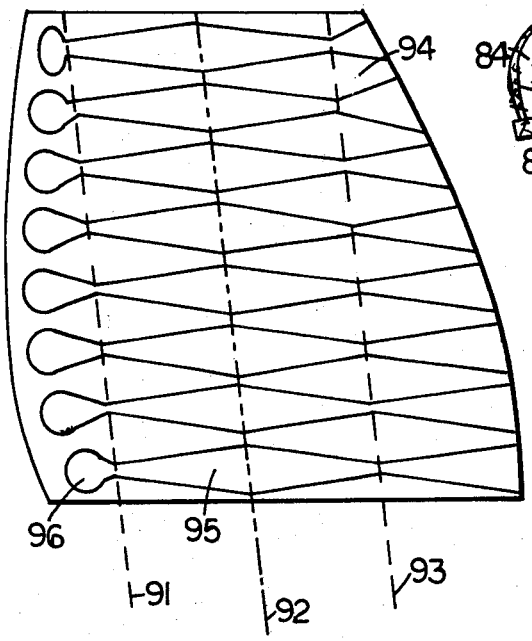
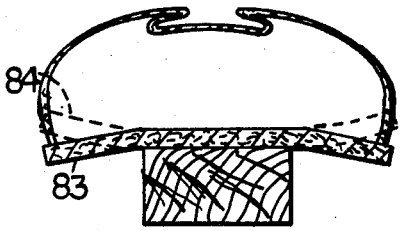
FIG. 9
FIG. 12
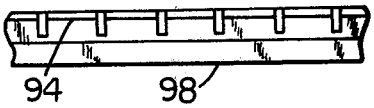
FIG. 10
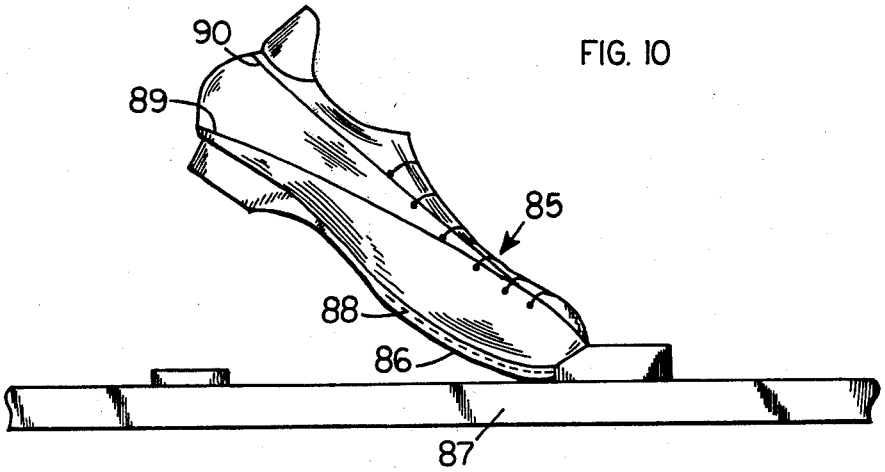

SHOE FOR USE WITH A CROSS-COUNTRY SKI

This is a division of application Ser. No. 892,770, filed Apr. 3, 1978, now U.S. Pat. No. 4,235,452.

The present invention relates to a ski.

Known ski bindings have a front jaw with a plurality of upwardly projecting pins adapted to engage in bores in the shoe sole. The shoe is held in a resilient strap which may be of varied structure. Ski bindings with snap closures are also known. U.S. Pat. No. 4,108,467 discloses a binding for use with a cross-country ski, which comprises a stirrup affixed to the ski and receiving an extension of the ski shoe sole which must be held in position by a pin passing therethrough. The pin may be the shaft of a screw which threadedly engages a cylinder mounted on the stirrup and which may be rotated. It is also possible for the pin to pass through the shoe sole extension transversely and horizontally, in which case it is formed and secured like a safety pin. This type of attachment of the sole extension to the binding is time-consuming and requires many component parts loss of one of which makes the entire binding useless.

Conventionally, the soles of ski shoes for use with a cross-country ski are of synthetic resin, and it is desirable to make these synthetic resin soles so that they do not warp. However, if a sole is resistant to flexure so that is does not tend to warp and if it extends in a flat plane, it cannot be used for cross-country skiing because such a stiff sole will rapidly tire the foot of the skier.

Extensive observations have shown that, even if the shoe fits well and is held securely in the binding as well as in the region of the heel, the lateral guidance of the ski is not optimal since lateral displacements of the forward portion of the foot and the uppers surrounding it are possible with respect to the shoe sole. Displacements up to about 10 mm have been observed. This results in an imprecise guidance of the ski, particularly in curves.

It is a primary object of this invention to improve a shoe for use in cross-country skiing by providing a lateral guidance that remains effective even when the shoe sole is worn.

The above and other objects are accomplished according to this invention with a cross-country ski comprising a sole means of synthetic resin, the sole means including a heel portion defining a recess of V-shaped cross section and upwardly projecting lateral edges forwardly of the heel portion.

The above and other objects, advantages and features of the invention will become more apparent from the following detailed description of certain now preferred embodiments thereof, taken in conjunction with the accompanying schematic drawing wherein FIGS. 1 to 4 schematically illustrate, in transverse cross section, comparisons between conventional ski shoe soles and a preferred embodiment of the sole means according to this invention;

FIG. 9 is a transverse section showing a preferred embodiment of the sole;

FIG. 10 illustrates a shoe with the sole of FIG. 9 and held on a ski; and FIGS. 11 and 12 are respectively bottom plan and sectional views illustrating transverse stiffening inserts for the sole.

Figure 2:
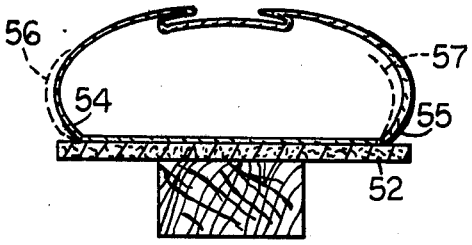
Figure 1:
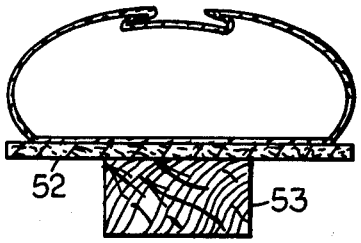

FIG. 1 shows a transverse cross section taken in the region of the ball of the foot of a conventional ski boot having a flat sole 52 supported on ski 53. As is indicated in FIG. 2, in this region of the largest width of the foot, portions 54 and 55 of the uppers may be readily replaced laterally to assume positions 55, 56 indicated in broken lines. This interferes with a secure lateral guidance and this disadvantage is overcome in accordance with one aspect of the present invention in the manner shown in FIGS. 3 and 4, the invention taking advantage of the manufacturing possibilities available by the use of synthetic resin as a sole material, which enables the sole to be injection molded.

Figure 3:
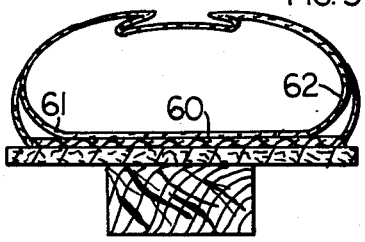
Figure 4:
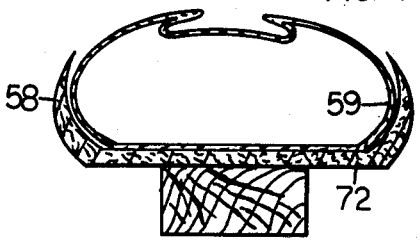

To prevent the lateral displacement of parts of the uppers, the synthetic resin sole means is provided with upwardly projecting lateral edges forwardly of the heel portion. In the modification of FIG. 3 the sole means comprises an outer sole and inner sole insert 60 with lateral edges 61 and 62 imparting a lateral stiffness to the uppers and thereby holding them against lateral displacement. In the modification of FIG. 4, the sole means is an outer sole and lateral edges 58 and 59 extend over the uppers of the shoe, with the same effect. The modification of FIG. 3 has the advantage that boots of different widths may be provided with different inner soles to adapt the boots to various foot widths. If desired, the inserts may have enhanced transverse stiffness in the region of the ball of the foot so that the impact of the ball on the underlying ski is reduced.

The upwardly projecting lateral sole edges must be flexible in the longitudinal direction of the foot, for which purpose they define a series of slots 63 to 68 extending substantially vertically to the sole means and sub-dividing the lateral edges into overlapping sections which cover the sides of the foot like the scales of a fish.

Figure 5:
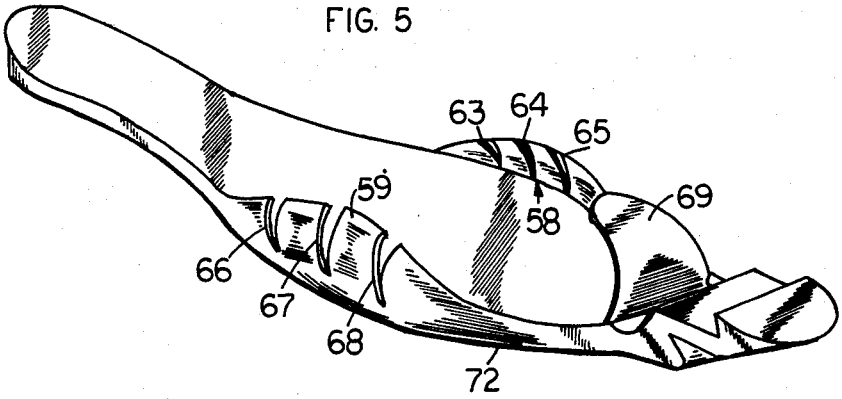
FIG. 5 is a perspective top view of the sole of FIG. 4.

Another weak point in conventional boots for use in cross-country skiing is the connection at the tip of the shoe between the sole and the uppers. Again taking advantage of the manufacturing capabilities afforded by the use of moldable or extrudable synthetic resin, it is preferred to provide the sole with flap 69 integral with the sole and arranged to cover the tip of the shoe, as shown in FIG. 5. The flap is pulled over the shoe tip and bonded thereto by an adhesive. This provides an effective and secure connection of the sole to the uppers at the forward portion of the shoe.

Because the lateral displacement forces exerted upon the uppers are stronger on the outside than on the inside, outer lateral edge 59 is proportioned to project to a higher level than inner lateral edge 58, as shown in FIG. 5. Since the overlapping edge sections interengage movably, they do not increase the rigidity of shoe sole 72.

Figure 7:
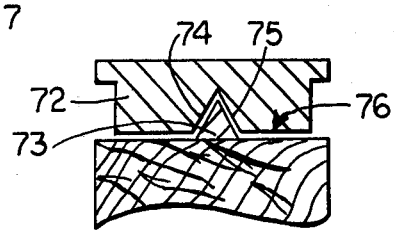
FIGS. 7 and 8 are end views of the heel portion, respectively illustrating a conventional engagement of the heel portion with the ski and the engagement according to FIG. 6.
Figure 8:
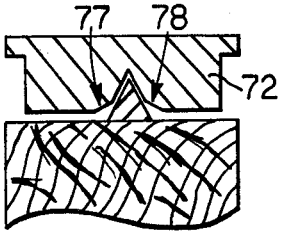
Figure 6:
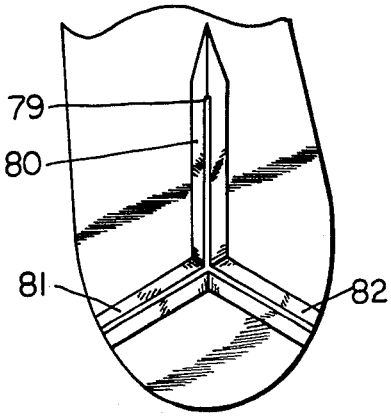
FIG. 6 is a bottom plan view of the heel portion of a sole incorporating a preferred feature of the invention.

As shown in FIGS. 6 to 8, the ski shoe of the invention has sole means including a heel portion defining a recess of V-shaped cross section defined by diverging walls 74 and 75, this V-shaped recess engaging a corresponding web 73 projecting from the ski surface so that the heel may be held on the ski against lateral displacement. Conventionally and as illustrated in FIG. 7, diverging walls 74, 75 extend down to the underside 76 of the heel. As the heel is lifted and lowered during cross-country skiing the corners at the recess are worn and resultant splinters from the ski surface impair the proper engagement of the recess with the web. Accordingly and in accordance with this invention, beveled transition zones 77 and 78 are provided between the underside 76 of the sole and the V-shaped recess defined between diverging walls 74, 75, as shown in FIG. 8. In this manner, the zone of engagement between web and recess is separated from the underside of the sole which rests on the ski and any wear of the sole or ski no longer causes a failure in the proper interengagement betwen the recess and web. In addition, the small spaces defined by the beveled transition zones will enable any snow lodged there to be compressed therein, rather than to stay in the interface between the ski and shoe sole.

It is also important to provide a broad support for the heel to reduce sidewise tilting in relation to the ski. This is obtained in accordance with the embodiment illustrated in FIG. 6 by providing a three-armed web 79, the V-shaped recess correspondingly comprising rectilinear center recess portion 80 and two diverging rectilinear recess portions 81 and 82 extending from an end of the center recess portion. The diverging V-shaped recess portions 81, 82 enclose an angle between 90° and 270°, preferably not exceeding 120°.

The heat insulating qualities of synthetic resin soles may be increased by laminating the same with synthetic resin films which do not transmit infrared radiation, thus providing additional protection for the feet of the skier against cold.

Boots for use in cross-country skiing must be light and flexible, particularly below the balls of the feet. Therefore, the soles of such boots are necessarily quite resilient in a transverse direction, which makes the lateral guidance of the ski very difficult.

Cross-country skis are narrow, in contrast to downhill skis whose width is aout 45 mm. Because of the narrowness of cross-country skis, the feet of the skier, particularly in the regions of the balls of the feet, overhang the ski laterally and vertical pushing forces up to 150 kg have been measured. Under such forces, as indicated in FIG. 9, the laterally over-hanging portions of sole 83 tend to curve down. The skier, therefore, feeds the pressure of the narrow ski against the sole of his foot, particularly in the center region. This causes undue fatigue and pain during a long cross-country run. While it is possible to reduce or avoid this difficulty by increasing the gauge of the sole and, thus, its rigidity, this produces a corresponding weight increase, which is undesirable.

As shown in FIG. 9, this difficulty is overcome if the sole extends in an upwardly curvilinear plane, i.e. it is concave in a transverse direction. Thus, a downward force will bring the sole into a flat condition, rather than curving downwardly over the lateral edges of the ski. This will relieve the pressure of the narrow ski against the foot sole and also will stretch the uppers when the overhanging lateral portions of the sole are straightened so that the uppers will be free of undesirable folds produced during cross-country skiing.

It has been found in the production of ski boots with curvilinear soles that it is difficult to mount the uppers on the insole. The transverse stiffness of the sole means, particularly below the region of the ball of the foot, may be increased by making the insole of a transversely sculptured sheet material which provides a strong moment of resistance in a transverse direction for the overhanging lateral portions of the sole without imparting any significant resistance to a rolling motion in the longitudinal direction of the ski. Since it is difficult to find a suitable material having the desired rigidity characteristics, the invention provides in the embodiment shown in FIG. 11 an insole of a rigid but thin sheet material, such as an aluminum sheet or a synthetic resin sheet, which is bonded to the outer sole in transverse strips. An aluminum sheet having a gauge of about 0.2 to 0.5 mm is sufficient for this purpose. In the bottom plan view of FIG. 11, the lateral edges of a ski are designated by numerals 91 and 93 while the central axis of the ski is designated 92. It will be noted that the width of the strips extending beyond ski edges 91 and 93 are widest where the load of the foot exerts the highest flexing forces and is reduced gradually from the lateral ski edges towards the ski axis. Thus, material is saved where it is not needed to stiffen the sole and the weight of the sole is held as low as possible. Other strip shapes are possible, of course, but the illustrated configuration will produce maximum stiffness with minimum weight. To form strips 94, transverse slits 95 end in rounded loops 96 adjacent ski edge 91 and leave a narrow rim interconnecting all strips to increase the lateral stiffness of the sole. At this part of the sole, the strongest pressure forces are transmitted from the foot to the sole. At the opposite side adjacent ski edge 93, there is no connection between the insole strips, slots 95 extending to the ends of the strips and the edge of the sole.

As shown in the transverse section of FIG. 12, which shows the shoe sole in the region of a ski edge, outer sole 97 carries insole 98 and an upper layer consisting of transverse strips 94. This produces a laminate consisting of outer sole, edge of uppers, insole and strips producing maximum stiffness with a minimum of material and weight. In most cases, an aluminum strip layer weighing about 2 to 3 grams will suffice, with weight of the strip layer configurated according to FIG. 11 being about 2 g while parallel strips will have a weight of about 3 g, with a sheet gauge of 0.2 mm. Slits 95 between the strips 94 are very important because, when the insole is flexed, the absence of such slits would cause the insole to be compressed only to width of the strips, which amounts to an increase in the rigidity in a longitudinal direction in comparison to a sole without transverse strips and which may be compressed uniformly along its entire length. The slits separate the strips from each other.

FIG. 10 shows peferred ski boot 85 with sole 86 transversely curved in the manner indicated in FIG. 9 to form a dome-shaped support particularly for the ball region of the foot. When the ski is pushed forward while the heel is raised, an optimal angle is obtained between shoe 85 and ski 37 if the shoe is cut and manufactured to fit the bent foot so that no force is required to move the shoe into the raised position shown in FIG. 10. When the ski is slid along the snow as the shoe sole rests on the ski surface, the weight of the skier will provide the required force and no muscle force is needed. The weight of the skier will simply press sole 86 flatly against the ski and the uppers will be tensioned. Elastic inserts, such as steel strips 88, may be provided in the sole, particularly in the region of the ball of the foot, to increase the transverse rigidity and resistance to warping of the sole so that the ski may be properly guided, particularly in curving paths and in climbs up steep hills. Such reliable transverse guidance has not been available with conventional cross-country ski boots.

FIG. 10 also shows two tensile elements 89 and 90 extending along the length of shoe 85 and enhancing the return of the shoe into its raised position.

What is claimed is:

1. A ski shoe for use with a cross-country ski having a web projecting from the ski surface and extending in the longitudinal direction of the ski, comprising a sole means of synthetic resin, the sole means including a heel portion defining a recess of V-shaped cross section extending in said direction for engaging the web and thereby holding the heel portion on the ski against lateral displacement, and upwardly projecting lateral edges arranged only forwardly of the heel portion.

2. The ski shoe of claim 1, wherein the sole means comprises an outer sole and an inner sole, the lateral edges projecting from the inner sole.

3. The ski shoe of claim 1, wherein the upwardly projecting lateral edges define a series of slots extending substantially verticaly to the sole means and sub-dividing the lateral edges into overlapping sections.

4. The ski shoe of claim 1, further comprising a flap integral with the sole and arranged to cover the tip of the shoe.

5. The ski shoe of claim 1 further comprising beveled transition zones between the underside of the sole and the V-shaped recess.

6. The ski shoe of claim 1, further comprising elastic inserts in the sole means.

7. The ski shoe of claim 1, further comprising a forwardly extending portion opposite the heel portion and laterally extending parts having a ribbed underside and leaving therebetween a longitudinally extending sole part for engagement with the ski.

8. A ski shoe for use with a cross-country ski having a three-armed web projecting from the ski surface and one arm extending in the longitudinal direction of the ski and two arms diverging therefrom, comprising sole means of synthetic resin, the sole means including a heel portion defining a recess of V-shaped cross section, the recess comprising a rectilinear center recess portion extending in said direction for engaging the one web arm and thereby holding the heel portion on the ski against lateral displacement as well as two diverging rectilinear recess portions extending from an end of the center recess portion for engaging the two diverging web arms, the diverging recess portions enclosing an angle between 90° and 270°, beveled transition zones extending between the underside of the sole and the V-shaped recess, and upwardly projecting lateral edges arranged only forward of the heel portion.

9. The ski shoe of claim 8, wherein the angle between the diverging recess portions does not exceed 120°.

10. A ski shoe for use with a cross-country ski having a web project from the ski surface and extending in the longitudinal direction of the ski, comprising sole means of synthetic resin extending in an upwardly curvilinear plane, the sole means including a heel portion defining a recess of V-shaped cross section extending in said direction for engaging the web and thereby holding the heel portion on the ski against lateral displacement, and upwardly projecting lateral edges arranged forwardly of the heel portion.

11. The ski shoe of claim 10, wherein the plane of the sole means is upwardly curvilinear in a transverse direction.

12. A ski shoe for use with a cross-country ski having a web projecting from the ski surface and extending in the longitudinal direction of the ski, comprising a sole means of synthetic resin comprising an outer sole and an inner sole of a rigid but thin sheet material bonded to the outer sole in transverse strips, the sole means including a heel portion defining a recess of V-shaped cross section extending in said direction for engaging the web and thereby holding the heel portion on the ski against lateral displacement, and upwardly projecting lateral edges forwardly of the heel portion.

13. The ski shoe of claim 12, wherein the sheet material is aluminum, the aluminum sheet material having a gauge of about 0.2 to 0.5 mm.

14. The ski shoe of claim 12 or 13, wherein the sole means has a portion adapted to be in registry with an underlying ski and extending between the two lateral edges of the ski, the transverse strips of the rigid but thin sheet material tapering inwardly in this portion from the lateral ski edges.

15. The ski shoe of claim 14, wherein the transverse strips are separated by transverse slits extending from one lateral edge of the sole means to rounded loops adjacent the opposite lateral edge of the sole means, a narrow rim of the sheet material between the rounded loops and the opposite lateral edge interconnecting the strips thereat.

16. A ski shoe for use with a cross-country ski, comprisng an integral sole means of synthetic resin, the sole means including an inner sole insert constituted by thin strips of rigid material extending transversely to the sole means and imparting stiffness to the sole means in a transverse direction, the sole means having lateral edges and a portion extending therebetween and adapted to be in registry with an underlying ski having lateral edges extending in the direction of the lateral edges of the sole means, the sole means portion being defined between two lines overlying the lateral ski edges, the strips tapering inwardly from said lines towards the lateral edges of the sole means, on the one hand, and towards the center of the sole means portion, on the other hand, and the strips having a maximum width along said lines.

17. The ski shoe of claim 16, further comprising narrow webs interconnecting the strips.

18. A ski shoe for use with a cross-country ski having a binding web with a plurality of arms extending at an angle to each other, comprising an integral sole means of synthetic resin, the sole means including a heel portion defining a recess with a like plurality of arms, the arms of the binding web and of the recess having complementary V-shaped cross sections for engagement with each other, and the sole means further including an inner sole insert imparting stiffness to the sole means in a transverse direction.

19. The ski shoe of claim 18, wherein the arms of the recess extend to respective ones of the heel portion edges.

20. The ski shoe of claim 18, wherein the height of the arms of the binding web exceeds the depth of the arms of the recess.

* * * * *